United States Patent [19]

Luckett

[11] Patent Number: 4,570,800

[45] Date of Patent: Feb. 18, 1986

[54] INSULATED FOOD CARRIER

[76] Inventor: Robert H. Luckett, 7313 S. Moore Ct., Littleton, Colo. 80127

[21] Appl. No.: 529,278

[22] Filed: Sep. 6, 1983

[51] Int. Cl.[4] ..... A45C 11/20; F25D 3/08; B65D 81/38

[52] U.S. Cl. ..... 206/545; 206/1.5; 206/549; 220/410; 220/20; 62/371

[58] Field of Search ..... 206/545, 549, 541, 544, 206/1.5; 220/410, 20; 62/371

[56] References Cited

U.S. PATENT DOCUMENTS

| | | | |
|---|---|---|---|
| 788,735 | 5/1905 | Stephan | 206/541 |
| 3,156,105 | 11/1964 | Bahner | 62/371 |
| 3,406,811 | 10/1968 | Higley | 206/545 |
| 3,666,338 | 5/1972 | Russell | 206/1.5 |

*Primary Examiner*—William T. Dixon, Jr.
*Attorney, Agent, or Firm*—Warren D. Flackbert

[57] ABSTRACT

An insulated food carrier characterized as a portable unit, useful for picnics, at job sites or the like, which maintains a precooked food item in a heated condition for an extended period of time. Entry to and for the food item is provided through a releasable wall portion, where an entry is provided in another wall portion of the unit for access to a storage compartment which serves to receive eating implements and the like. A recessed handle arrangement achieves effective carrying needs. In any event, the overall carrier is presented in a form including plastic outer and inner surfaces containing insulation, such as expanded polystyrene, therebetween.

2 Claims, 4 Drawing Figures

INSULATED FOOD CARRIER

As is known, the usage of food carriers, for picnics, on the job meals, and the like, is widespread, where, however, a difficulty inherent with the food carriers presently on the market resides in the inability thereof to supply a heated meal for the user. In other words, mostly sandwich items, fruit or other particular non-perishable food is supplied, where, in the instance of the desire for either a hot or cold beverage, a "thermos" container is generally employed. Oftentimes, however, and particularly under warm and/or hot weather conditions, ice or similar cooling material is employed, in loose fashion, within the carrier to avoid food spoilage and, as well, to make the food items at hand more palatable.

The invention presents an insulated food carrier which, importantly, serves to maintain the carried food item at a desired warmed or heated temperature. In other words, with the invention, the user can preheat a frozen prepackaged dinner, as commonly available on a tray, in an oven, and then transfer such to the instant carrier for consumption at a meal hour sometime later after initial preparation/heating.

Basically, the invention is defined as a plastic unit having outer and inner walls separated by insulation, such as expanded polystyrene, for example, and presenting a food storage area or compartment and, as a matter of further example, a storage area or compartment for eating implements, condiments and the like. Entry to the unit may be provided through a releasable wall portion, selectively arranged to prevent heat loss, i.e. effective sealing is presented around the defined entry. The bottom surface of the food receiving compartment may be ribbed for ease in food placement, also providing added air circulation, and, if desired, the arrangement can be modified whereby multi-layers of food items, as on the aforesaid trays, may be carried.

The unit further includes, as stated, a storage compartment or space at another portion thereof where access thereto can be accomplished through a self-hinged door or entry in a wall portion. In order to facilitate portability, a recessed handle arrangement is provided in the upper surface of the unit for ready grasping by the user. In other words, and restated, the importance of the invention lies in its particular utility in carrying and maintaining heated food items for consumption at a desired later time.

A better understanding of the present invention will become more apparent from the following description, taken in conjunction with the accompanying drawing, wherein FIG. 1 is a view in vertical section showing an insulated food carrier in accordance with the teachings of the present invention;

Figure 1:
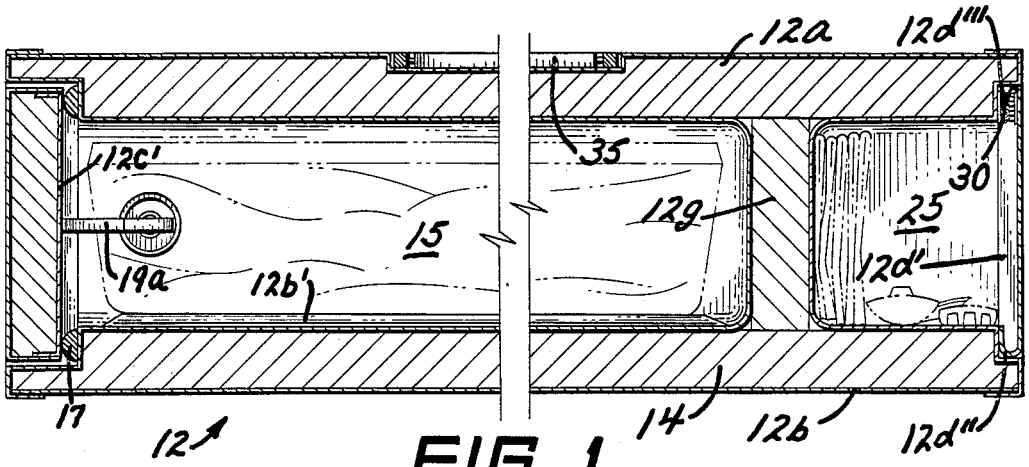

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the insulated food carrier 12 presented by the invention assumes a six sided or box-like configuration, more specifically described as a top wall 12*a*, a bottom wall 12*b*, end walls 12*c* and 12*d*, and side walls 12*e* and 12*f*. Further, an intermediate wall 12*g* extends between the top wall 12*a*, the bottom wall 12*b*, and the side walls 12*e* and 12*f*. Each of the aforesaid walls 12*a*, 12*b*, 12*c*, 12*e*, 12*f* and 12*g* is typically defined by plastic outer and inner surfaces with a layer of insulative material 14, such as expanded polystyrene, for example, disposed therebetween.

As evident, the preceding plays particular significance in that walls 12*a*, 12*b*, 12*c*, 12*e*, 12*f* and 12*g* surround an area or compartment 15 for receiving a heated food item or items, where the latter are typically disposed within a container or tray (shown in phantom in FIG. 1). While a single container or tray is illustrated herein, it should be understood that a series of trays may be employed, as stacked directly onto each other (not shown) or on receiving brackets (also not shown) on the inner surfaces of the side walls 12*e* and 12*f*.

Figure 2:
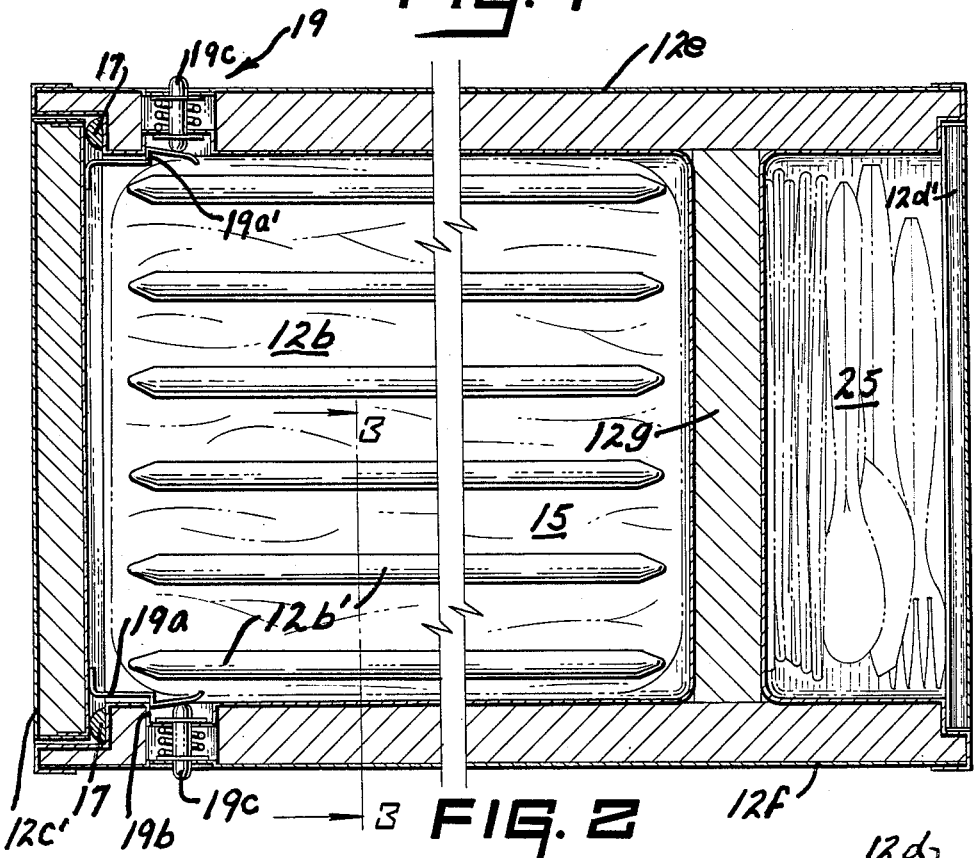
FIG. 2 is a view in horizontal section, i.e. looking downwardly on the presentation of FIG. 1, further showing the typical insulated food carrier presented herein.
Figure 3:
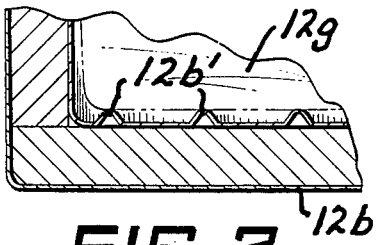
FIG. 3 is a fragmentary view in vertical section, taken at line 3—3 on FIG. 2 and looking in the direction of the arrows, detailing a portion of the food item receiving surface; and, FIG. 4 is a perspective overall view of the instant insulated food carrier in condition for either transporting and/or storage.
Figure 4:
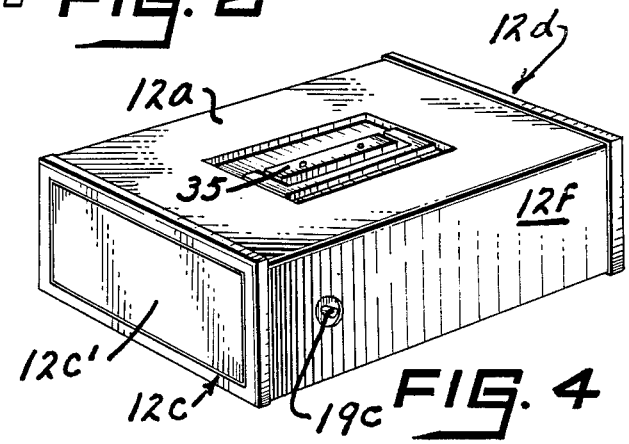

In any event, the food item receiving area or compartment 15 may include a ribbed bottom surface 12*b*' (see FIGS. 2 and 3), for ease in food tray or container placement and, as well, for promoting air circulation within the food receiving compartment or area 15.

The end wall 12*c* includes a door or entry 12*c*' (see FIGS. 1 and 2), also having plastic inner and outer surfaces with a layer of insulative material 14 therebetween. Gaskets or other sealing means 17 are disposed around the opening for the door or entry 12*c*' to prevent heat loss.

A typical door or entry 12*c*' release arrangement 19 is provided (again see FIGS. 1 and 2) which includes resilient arms 19*a* each extending from the inner surface of the door or entry 12*c*' and having an offset catching portion 19*a*', i.e. cooperable with an edge of an opening 19*b* in the inner surface of the side walls 12*e* and 12*f*. Spring-urged buttons 19*c* are disposed within such openings 19*b*, where, with the application of an inward force, the latching and/or retaining relationship is released, whereby the door or entry 12*c*' can be removed. Upon release, the spring assembly associated with each button 19*c* urges or permits the arms 19*a* to each return to the latching position indicated in FIG. 2.

The preceding is representative in form, where the basic factors under consideration include (1) adequate sealing to prevent, as stated, heat loss around the door or entry 12*c*' and (2) ready door or entry 12*c*' release associated with a positive locking and/or retaining relationship, where the geometry of the latter also aids in heat retention.

While not necessarily insulated in form, a door or entry 12*d*' in end wall 12*d* serves as a closure for a storage area or compartment 25 for receiving and storing serving implements, condiments and/or the like. The door or entry 12*d*' to such storage area or compartment 25 may assume various mounting arrangements where, in the illustrated form, a living hinge 12*d*''' is provided at one end thereof with a loop-pile arrangement 12*d*'''' presented at the opposite end. In order to gain access and achieve entry or door 12*d*' movement, a fingernail type opening 30 may be provided at or adjacent the top thereof.

The assembly is completed through a recessed handle arrangement 35 disposed in the top wall 12*a* of the unit. The latter is typical in form, not unlike the type found on tool kits, fisherman's bait or tackle boxes, and the like.

It should be evident from the preceding that the insulated food carrier of the invention achieves the ready transporting of a hot or heated food item, such as a commercially available tray contained "TV" dinner, and, thereby, affords the availability of a hot meal at a location remote from a cooking area, such as at a construction site. The instant carrier is unlike a known "thermos" jug which primarily serves liquid holding purposes, i.e. not, and in contrast to, a ready to eat heated meal.

The above described insulated food carrier is susceptible, however, to various changes within the spirit of the invention, including proportioning, particular access arrangements, and the like. Thus, the preceding description should be considered illustrative and not as limiting the scope of the following claims.

I claim:

1. In combination with a tray containing a heated food product, a portable carrier comprising a thermally insulated top wall, bottom wall, side walls and end walls defining a compartment for receiving said tray containing heated food product, where one of said end walls is selectively removable in a compartment entry relationship, being spring urged to and from a closed portion by release arrangements extending through said side walls, where said tray is slidably and removably disposed within and from said compartment, where an opposite end wall is stationary and serves as a common wall for an adjacent auxiliary normally closed storage compartment defined by portions of said top wall, said bottom wall and said side walls, where said auxiliary storage compartment includes a hinged entry in the form of a wall opposite to said common wall, where said one of said end walls and said hinged entry approximate the same surface area, and where carrying means is disposed on said top wall.

2. The combination of claim 1 where the inside surface of said bottom wall is ribbed.

* * * * *